US009376891B2

(12) United States Patent
Reid et al.

(10) Patent No.: US 9,376,891 B2
(45) Date of Patent: Jun. 28, 2016

(54) VALVE ACTUATING APPARATUS

(71) Applicant: HALLIBURTON MANUFACTURING & SERVICES LIMITED, Leatherhead (GB)

(72) Inventors: Michael Adam Reid, Scotlant (GB); Gary Henry Smith, Scotland (GB)

(73) Assignee: Halliburton Manufacturing & Services Limited, Leatherhead (GB)

( * ) Notice: Subject to any disclaimer, the term of this patent is extended or adjusted under 35 U.S.C. 154(b) by 711 days.

(21) Appl. No.: 13/648,463

(22) Filed: Oct. 10, 2012

(65) Prior Publication Data

US 2013/0098624 A1 Apr. 25, 2013

(30) Foreign Application Priority Data

Oct. 11, 2011 (GB) ..... 1117507.2

(51) Int. Cl.

*E21B 34/10* (2006.01)
*E21B 34/14* (2006.01)
*E21B 34/06* (2006.01)

(52) U.S. Cl.

CPC ..... *E21B 34/10* (2013.01); *E21B 34/06* (2013.01); *E21B 34/107* (2013.01); *E21B 34/14* (2013.01)

(58) Field of Classification Search

CPC ..... E21B 34/10; E21B 34/14
USPC ..... 166/332.3, 332.1, 319, 374
See application file for complete search history.

(56) References Cited

U.S. PATENT DOCUMENTS

| | | | |
|---|---|---|---|
| 1,448,818 | A | 3/1923 | Stokes |
| 2,042,817 | A | 6/1936 | Wilcox |
| 2,599,774 | A | 6/1952 | Ohls |
| 2,710,655 | A | 6/1955 | Haskell |
| 2,883,146 | A | 4/1959 | Knox |
| 2,916,254 | A | 12/1959 | Wendell |
| 3,072,379 | A | 1/1963 | Hamer |
| 3,241,808 | A | 3/1966 | Allen |
| 3,395,758 | A | 8/1968 | Kelly et al. |

(Continued)

FOREIGN PATENT DOCUMENTS

| | | |
|---|---|---|
| CA | 2485810 | 4/2005 |
| EP | 0427371 | 5/1991 |

(Continued)

OTHER PUBLICATIONS

UK Intellectual Property Office, Search Report of UK Patent Application No. GB 1117507.2 (foreign priority application), Jan. 20, 2012. Search Report issued in connection with UK priority patent application prior to filing instant U.S. patent application.

(Continued)

*Primary Examiner* — Kenneth L Thompson
(74) *Attorney, Agent, or Firm* — Benjamin Fite; Fish & Richardson P.C.

(57) ABSTRACT

An actuating apparatus for a downhole valve including a tubular body. The tubular body includes an axial bore that extends through the body. An inlet port extends radially and at least partially through the tubular body. When open, the inlet port is arranged to be in fluid communication with a region uphole of the actuating apparatus. The actuating apparatus also includes an actuating member that is operable by application of fluid pressure from a region uphole of the actuating apparatus via an open inlet port to actuate the valve.

20 Claims, 8 Drawing Sheets

(56) References Cited

U.S. PATENT DOCUMENTS

| | | | | |
|---|---|---|---|---|
| 3,424,190 | A | 1/1969 | Wolfensperger | |
| 3,472,484 | A | 10/1969 | Parker | |
| 3,503,445 | A * | 3/1970 | Cochrum | E21B 21/103 166/151 |
| 3,581,820 | A | 6/1971 | Burns | |
| 3,675,718 | A * | 7/1972 | Kanady | E21B 23/04 166/297 |
| 3,732,925 | A * | 5/1973 | Kanady | E21B 34/16 166/321 |
| 3,815,676 | A | 6/1974 | Read | |
| 3,960,363 | A | 6/1976 | Domyan | |
| 3,061,267 | A | 10/1976 | Hamer | |
| 3,993,130 | A | 11/1976 | Papp | |
| 4,022,426 | A | 5/1977 | Read | |
| 4,022,427 | A | 5/1977 | Read | |
| 4,029,292 | A | 6/1977 | Kramer et al. | |
| 4,080,982 | A | 3/1978 | Maezawa | |
| 4,119,146 | A * | 10/1978 | Taylor | E21B 34/107 137/111 |
| 4,249,599 | A * | 2/1981 | Krause | E21B 34/102 166/319 |
| 4,281,715 | A | 8/1981 | Farley | |
| 4,315,542 | A | 2/1982 | Dockins, Jr. | |
| 4,355,685 | A | 10/1982 | Beck | |
| 4,406,335 | A | 9/1983 | Koot et al. | |
| 4,421,174 | A * | 12/1983 | McStravick et al. | 166/374 |
| 4,506,693 | A | 3/1985 | Acker | |
| 4,519,579 | A | 5/1985 | Brestel et al. | |
| 4,606,368 | A | 8/1986 | McCafferty | |
| 4,616,857 | A | 10/1986 | Woodman et al. | |
| 4,700,924 | A | 10/1987 | Nelson et al. | |
| 4,709,762 | A | 12/1987 | Pringle et al. | |
| 4,776,395 | A | 10/1988 | Baker et al. | |
| 4,782,896 | A | 11/1988 | Witten | |
| 4,796,705 | A | 1/1989 | Carmody et al. | |
| 4,815,701 | A | 3/1989 | Stone | |
| 4,903,775 | A | 2/1990 | Manke | |
| 4,921,044 | A | 5/1990 | Cooksey | |
| 4,949,788 | A | 8/1990 | Szarka et al. | |
| 4,991,654 | A | 2/1991 | Brandell et al. | |
| 5,101,907 | A | 4/1992 | Schultz et al. | |
| 5,263,683 | A | 11/1993 | Wong | |
| 5,316,084 | A | 5/1994 | Murray et al. | |
| 5,529,126 | A | 6/1996 | Edwards | |
| 5,547,029 | A | 8/1996 | Rubbo et al. | |
| 5,615,548 | A | 4/1997 | Winfree et al. | |
| 5,865,246 | A | 2/1999 | Brown | |
| 5,875,852 | A | 3/1999 | Floyd et al. | |
| 5,911,285 | A | 6/1999 | Stewart et al. | |
| 6,003,834 | A | 12/1999 | Read | |
| 6,041,864 | A | 3/2000 | Patel et al. | |
| 6,044,908 | A | 4/2000 | Wyatt | |
| 6,145,595 | A * | 11/2000 | Burris, II | 166/374 |
| 6,276,458 | B1 | 8/2001 | Malone et al. | |
| 6,298,919 | B1 * | 10/2001 | Browne | E21B 21/10 166/332.4 |
| 6,308,783 | B2 | 10/2001 | Pringle et al. | |
| 6,315,047 | B1 * | 11/2001 | Deaton et al. | 166/319 |
| 6,450,255 | B2 | 9/2002 | Carmody et al. | |
| 6,550,541 | B2 * | 4/2003 | Patel | 166/386 |
| 6,575,237 | B2 | 6/2003 | Purkis et al. | |
| 6,668,936 | B2 * | 12/2003 | Williamson, Jr. | E21B 34/10 166/240 |
| 6,684,950 | B2 | 2/2004 | Patel | |
| 6,715,558 | B2 | 4/2004 | Williamson | |
| 6,776,240 | B2 | 8/2004 | Kenison et al. | |
| 6,782,952 | B2 | 8/2004 | Garay et al. | |
| 6,860,330 | B2 | 3/2005 | Jackson | |
| 6,880,638 | B2 | 4/2005 | Haughom et al. | |
| 6,951,331 | B2 | 10/2005 | Haughom et al. | |
| 6,974,121 | B2 | 12/2005 | Koester et al. | |
| 7,204,315 | B2 * | 4/2007 | Pia | 166/373 |
| 7,258,323 | B2 | 8/2007 | Dwivedi | |
| 7,306,043 | B2 | 12/2007 | Toekje et al. | |
| 7,597,150 | B2 | 10/2009 | Clem | |
| 7,614,452 | B2 * | 11/2009 | Kenison et al. | 166/321 |
| 7,690,432 | B2 | 4/2010 | Noske et al. | |
| 8,316,953 | B2 | 11/2012 | Reid | |
| 8,602,112 | B2 | 12/2013 | Reid | |
| 2002/0046845 | A1 | 4/2002 | Rayssiguier et al. | |
| 2002/0053438 | A1 | 5/2002 | Williamson, Jr. | |
| 2002/0066574 | A1 | 6/2002 | Leismer et al. | |
| 2003/0047702 | A1 | 3/2003 | Gunnarsson et al. | |
| 2004/0035578 | A1 | 2/2004 | Ross et al. | |
| 2004/0041120 | A1 | 3/2004 | Haughom et al. | |
| 2004/0046143 | A1 | 3/2004 | Haughom et al. | |
| 2004/0112608 | A1 | 6/2004 | Jackson | |
| 2004/0154839 | A1 | 8/2004 | McGarian et al. | |
| 2005/0087344 | A1 | 4/2005 | Toekje et al. | |
| 2005/0151107 | A1 | 7/2005 | Shu | |
| 2005/0224235 | A1 | 10/2005 | Patel | |
| 2005/0230118 | A1 | 10/2005 | Noske et al. | |
| 2007/0102163 | A1 | 5/2007 | Heath et al. | |
| 2007/0187106 | A1 | 8/2007 | Wolters | |
| 2007/0187107 | A1 | 8/2007 | Pringle | |
| 2007/0204999 | A1 | 9/2007 | Cowie et al. | |
| 2008/0203346 | A1 | 8/2008 | Shu | |
| 2009/0050335 | A1 | 2/2009 | Mandrou | |
| 2009/0071658 | A1 | 3/2009 | Reid et al. | |
| 2009/0288838 | A1 | 11/2009 | Richards | |
| 2010/0071962 | A1 | 3/2010 | Beuershausen | |
| 2011/0000679 | A1 | 1/2011 | Joseph et al. | |
| 2011/0061875 | A1 | 3/2011 | Tips et al. | |
| 2011/0203809 | A1 | 8/2011 | Knobloch, Jr. et al. | |
| 2012/0261137 | A1 | 10/2012 | Martinez et al. | |
| 2012/0312547 | A1 | 12/2012 | Miller | |
| 2013/0000922 | A1 | 1/2013 | Skinner et al. | |
| 2013/0087341 | A1 | 4/2013 | Reid | |
| 2013/0087344 | A1 | 4/2013 | Reid | |
| 2013/0092380 | A1 | 4/2013 | Reid | |

FOREIGN PATENT DOCUMENTS

| | | |
|---|---|---|
| EP | 1136649 | 9/2001 |
| EP | 1241322 | 3/2002 |
| EP | 1350007 | 10/2005 |
| EP | 1350008 | 10/2005 |
| GB | 939999 | 10/1963 |
| GB | 2201979 | 9/1988 |
| GB | 2293433 | 3/1996 |
| GB | 2344152 | 5/2000 |
| GB | 2377743 | 1/2003 |
| GB | 2388854 | 11/2003 |
| GB | 2396633 | 6/2004 |
| GB | 2397316 | 7/2004 |
| GB | 2411677 | 9/2005 |
| GB | 2425585 | 11/2006 |
| GB | 2434814 | 8/2007 |
| GB | 2451288 | 1/2009 |
| GB | 2473092 | 3/2011 |
| WO | WO99/45231 | 9/1999 |
| WO | WO01/86113 | 11/2001 |
| WO | WO03/001019 | 1/2003 |
| WO | WO2004057689 | 7/2004 |
| WO | WO2005052302 | 6/2005 |
| WO | WO2005052313 | 6/2005 |
| WO | WO2009033018 | 3/2009 |
| WO | WO 2009/132462 | 11/2009 |
| WO | WO2010129631 | 11/2010 |
| WO | WO2011002676 | 1/2011 |
| WO | WO2011072367 | 6/2011 |

OTHER PUBLICATIONS

Examiner Susan Morrish, Extended European Search Report, European Application No. 12185092.9, Mar. 18, 2014, 5 pages.

Extended European Search Report, European Application No. 14195113.7, Mar. 13, 2015, 5 pages.

Fisher Product Bulletin—"Type Vee-Ball Designs V150, V200 and V300", Rotary Control Valves, Apr. 2005.

PCT/GB2006/000669; International Preliminary Report dated Aug. 28, 2007.

PCT/GB2006/000669; International Search Report dated Jun. 14, 2006.

(56) References Cited

OTHER PUBLICATIONS

UK Intellectual Property Office, Search Report of UK Patent Application No. GB 1117502.3 (foreign priority application), Jan. 20, 2012. Search Report issued in connection with UK priority patent application prior to filing instant U.S. patent application.
UK Intellectual Property Office, Search Report of UK Patent Application No. GB 1117505.6 (foreign priority application), Jan. 19, 2012. Search report issued in connection with UK priority application prior to filing instant US patent application.
UK Intellectual Property Office, Search Report of UK Patent Application No. GB 1117511.4 (foreign priority application), Jan. 22, 2012. Search report issued in connection with UK priority application prior to filing instant US patent application.
UK Search Report: Appln. GB1019746.5; Date of Search: Jan. 28, 2011.

* cited by examiner

VALVE ACTUATING APPARATUS

CROSS REFERENCE TO RELATED APPLICATIONS

The present application claims priority to United Kingdom Patent Application No. GB1117507.2, filed Oct. 11, 2011, and titled VALVE ACTUATING APPARATUS, the contents of which are expressly incorporated herein by reference.

BACKGROUND OF THE INVENTION

1. Field of the invention

The present invention relates to valve actuating apparatus for actuation of a downhole valve assembly. In particular, the present invention relates to a valve actuating apparatus that provides a contingency/back-up device operable to actuate a downhole valve that has failed to operate.

2. Description of the related art

Well completion involves various downhole procedures prior to allowing production fluids to flow thereby bringing the well on line. One of the downhole procedures routinely carried out during well completion is pressure testing where one downhole section of the well is isolated from another downhole section of the well by a closed valve mechanism such that the integrity of the wellbore casing/liner can be tested.

Well completion generally involves the assembly of downhole tubulars and equipment that is required to enable safe and efficient production from a well. In the following, well completion is described as being carried out in stages/sections. The integrity of each section may be tested before introducing the next section. The terms lower completion, intermediate completion and upper completion are used to describe separate completion stages that are fluidly coupled or in fluid communication with the next completion stage to allow production fluid to flow.

Lower completion refers to the portion of the well that is across the production or injection zone and which comprises perforations in the case of a cemented casing such that production flow can enter the inside of the production tubing such that production fluid can flow towards the surface.

Intermediate completion refers to the completion stage that is fluidly coupled to the lower completion and upper completion refers to the section of the well that extends from the intermediate completion to carry production fluid to the surface.

During testing of the intermediate completion stage the lower completion is isolated from the intermediate completion by a closed valve located in the intermediate completion. When the integrity of the tubing forming the intermediate completion section is confirmed the upper completion stage can be run-in.

Generally the completion stages are run-in with valves open and then the valves are subsequently closed such that the completion stages can be isolated from each other and the integrity of the production tubing and the well casing/wall can be tested.

Typically, the valves remain downhole and are opened to allow production fluids to flow. By opening the valves the flow of production fluids is not impeded.

In the event that a valve fails to open, for example where the valve or an actuating mechanism operable to open the valve becomes jammed, remedial action is generally required because a failed valve effectively blocks the production path.

Remedial action often involves removing the valve. The valve may be removed by milling or drilling the valve out of the wellbore to provide a free flowing path for production fluid.

It will be appreciated that resorting to such remedial action can result in costly downtime because production from the well is stopped or delayed. The remedial action may result in damage to the well itself where milling or drilling the valve or valves from the wellbore may create perforations in the production tubing or the well casing or well lining. As a result such actions would preferably be avoided.

In the above the importance of opening a valve to allow production to flow has been discussed. However, in the situation of a producing well requiring workover it is equally important to be able to isolate sections of the well to stop/halt production flow.

Conventionally, control lines from surface facilitate fluid communication downhole to the valves in order to close the valves. However in the event of a valve failing to close it may not be possible to continue with workover.

Therefore, it is desirable to provide a downhole device such that production downtime due to a failed valve is reduced.

It is further desirable to provide an actuating apparatus that helps to avoid using remedial actions such as milling or drilling to remove a failed valve from an intermediate or upper completion section of a wellbore.

It is further desirable to provide an actuating apparatus that provides a secondary actuating mechanism in order to actuate a failed valve located in the wellbore.

BRIEF SUMMARY OF THE INVENTION

A first aspect of the present invention provides an actuating apparatus for a downhole valve; the actuating apparatus comprises:

a tubular body comprising an axial bore extending through the body;

an inlet port extending radially and at least partially through the tubular body;

the inlet port being in fluid communication, when open, with a region uphole of the actuating apparatus; and an actuating member operable by application of fluid pressure from a region uphole of the actuating apparatus via the inlet port to actuate the valve.

The actuating member may comprise a piston member. Fluid pressure may be applied to the piston member via the inlet port such that movement of the piston member facilitates actuation of the valve. Hydraulic fluid may be contained on a side of the piston member opposite the inlet port. Movement of the piston member may displace the hydraulic fluid through an outlet.

The outlet may be fluidly coupled to a downhole valve such that the operation of the actuating member to displace the hydraulic fluid may be operable to actuate the valve.

Fluid communication between the actuating apparatus and the valve may be provided by a conduit that is contained within a downhole completion. The conduit may extend between the outlet of the actuating apparatus and the downhole valve.

The inlet, when open, may fluidly couple a region uphole of the actuating apparatus and the valve.

The actuating apparatus may comprise a hydraulic actuator for each valve to be operated downhole. The actuating apparatus may be operable to simultaneously operate each hydraulic actuator and hence each downhole valve.

The actuating apparatus according to embodiments of the present invention may provide a secondary actuator that is operable to actuate a valve that has failed to open or close in response to a primary actuator.

The actuating apparatus according to a first embodiment of the present invention may further comprise a mechanically actuated operating member. The mechanically actuated operating member may be operable to move between a first position and a second position.

When the mechanically actuated operating member is in the first position, fluid communication via the inlet port may be disabled.

When the mechanically actuated operating member is in the second position, fluid communication via the inlet port may be enabled.

Movement of the mechanically actuated operating member to the second position may selectively open the inlet port thereby priming the actuating apparatus for use.

Mechanical actuation of the mechanically actuated operating member may be provided by mechanical engagement of the mechanically actuated operating member with a downhole tool such as a stinger or a washpipe and disengagement of the actuating member from the downhole tool. Accordingly, the mechanically actuated operating member may comprise a coupling member operable to couple with a corresponding coupling member on the downhole tool.

Removal of the downhole tool, in a generally uphole direction may engage the coupling member of the downhole tool with the coupling member of the operating member such that the operating member may be moved to open the inlet port. Movement of the operating member may comprise sliding. The coupling member of the downhole tool and the coupling member of the operating member may disengage when the actuating apparatus is primed.

The operating member may comprise a sleeve.

The inlet port of the actuating apparatus according to the first embodiment of the invention may be open to the axial bore side of the tubular body.

The application of tubing pressure from an uphole region of the actuating apparatus may be operable to actuate a downhole valve via the inlet port.

The actuating apparatus according to the first embodiment of the present invention may be operable to open a downhole valve upon application of fluid pressure through the axial bore of the tubular body from a region uphole of the apparatus.

An actuating apparatus according to a second embodiment of the present invention may comprise an inlet port that is open to an annulus region uphole of the valve and the actuating apparatus.

The actuating apparatus according to the second embodiment of the present invention may be located uphole of a packer in a wellbore/completion assembly.

The actuating apparatus according to the second embodiment of the present invention may be operable to actuate a downhole valve upon application of fluid pressure via an annulus defined by the outside of the tubular body and the inside of a well in which the actuation apparatus is installed.

Fluid pressure may be applied from the annulus in a region uphole of the actuating apparatus.

The actuating apparatus according to the second embodiment of the present invention may be operable to open or close a downhole valve.

Advantageously, the actuating apparatus according to the embodiments of the present invention may provide a secondary actuator that is operable to actuate a valve that has failed to open or close in response to a primary actuator. For example, an actuating apparatus according to the first embodiment of the present invention may be suitable for use where upon completion of pressure testing a downhole valve has failed to open or in the event that a valve has failed to close preceding well workover.

Advantageously, the actuating apparatus according to embodiments of the present invention may provide means of restoring production flow following workover of a well, where downhole valves have become disconnected from surface on removal of the stinger and the completion assembly.

BRIEF DESCRIPTION OF THE SEVERAL VIEWS OF THE DRAWINGS

Embodiments of the present invention will now be described, by way of example only, with reference to the accompanying drawings, in which.

DETAILED DESCRIPTION OF THE INVENTION

Figure 1:
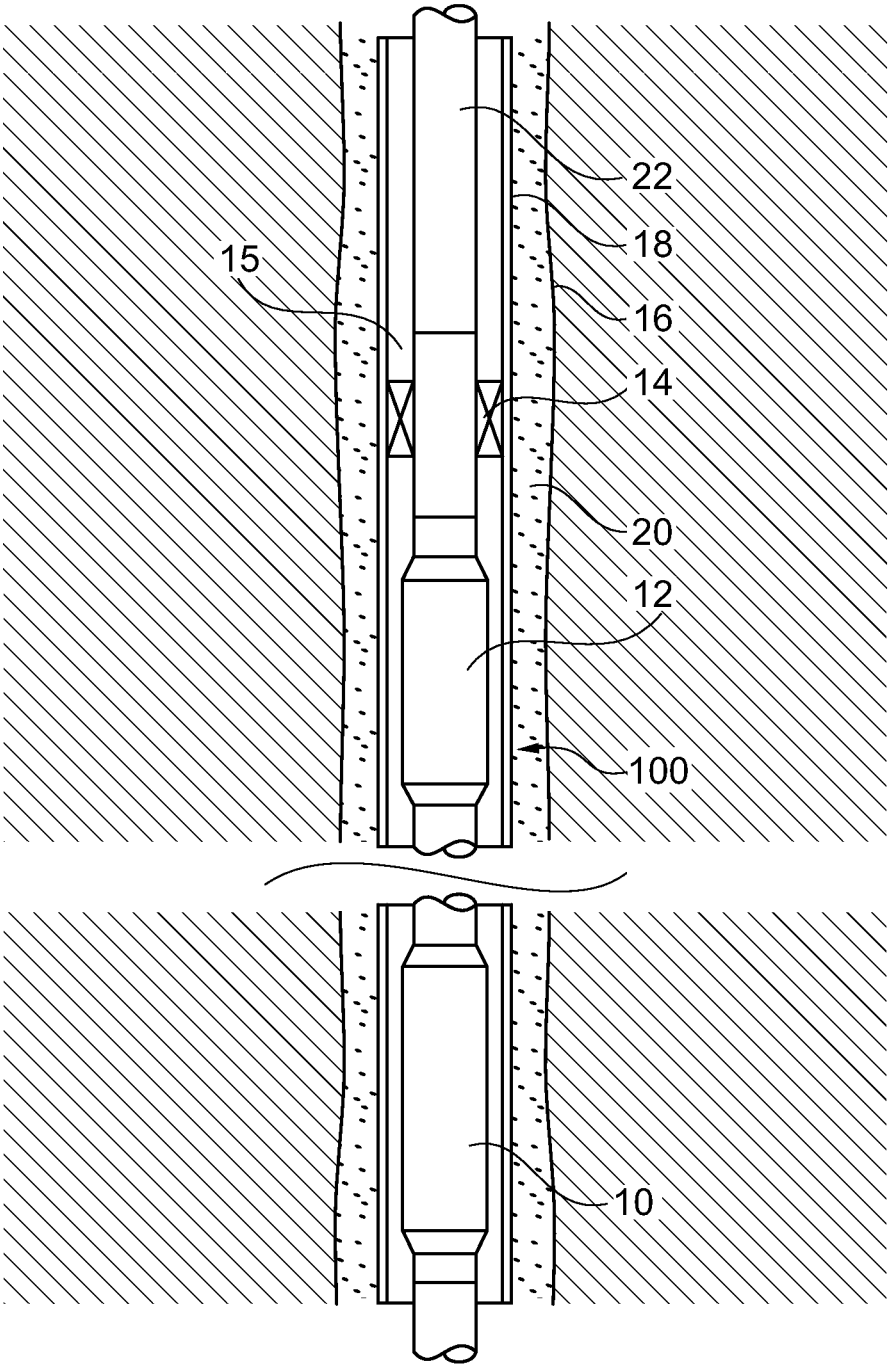
FIG. 1 is a schematic representation of a wellbore assembly comprising an actuating apparatus in accordance with a first embodiment of the present invention.

Referring to FIG. 1, a partial longitudinal view of a wellbore completion arrangement 100 is illustrated. The wellbore completion arrangement 100 comprises a downhole valve assembly 10, an actuating apparatus 12 and a packer assembly 14.

In the illustrated example, a wellbore 16 is lined with a casing 18, which in the illustrated embodiment is held in place with cement 20.

The downhole valve assembly 10, the actuating apparatus 12 and the packer assembly 14 are all run into the wellbore as part of the well completion assembly 100 on a stinger or washpipe (not illustrated).

For illustrative purposes, FIG. 1 does not indicate any specific form or type of downhole valve assembly 10. Suitable valve assemblies 10 will be discussed further below with respect to the action of the actuating apparatus 12 according to embodiments of the present invention.

The packer assembly 14 provides a seal in the annulus region 15, which is defined by the space between the outside of the production tubing 22 and the inside of the casing 18.

In the illustrated embodiment the downhole valve assembly 10 is run-in in an open configuration and is subsequently closed when it has reached its location downhole. Once closed, fluid pressure can be applied from above the downhole valve assembly 10 to check the integrity of the casing 18 and the well 100. Following successful testing the downhole valve assembly 10 can be opened again such that production fluid can flow unimpeded through the downhole valve assembly 10 when the well is brought on line.

The downhole valve assembly 10 can be opened by suitable means, for example fluid pressure from control lines to surface (not illustrated), mechanical actuation (not illustrated) or remote electronic actuation (not illustrated). Examples of suitable valves are ball valves and flapper valves.

Figure 2:
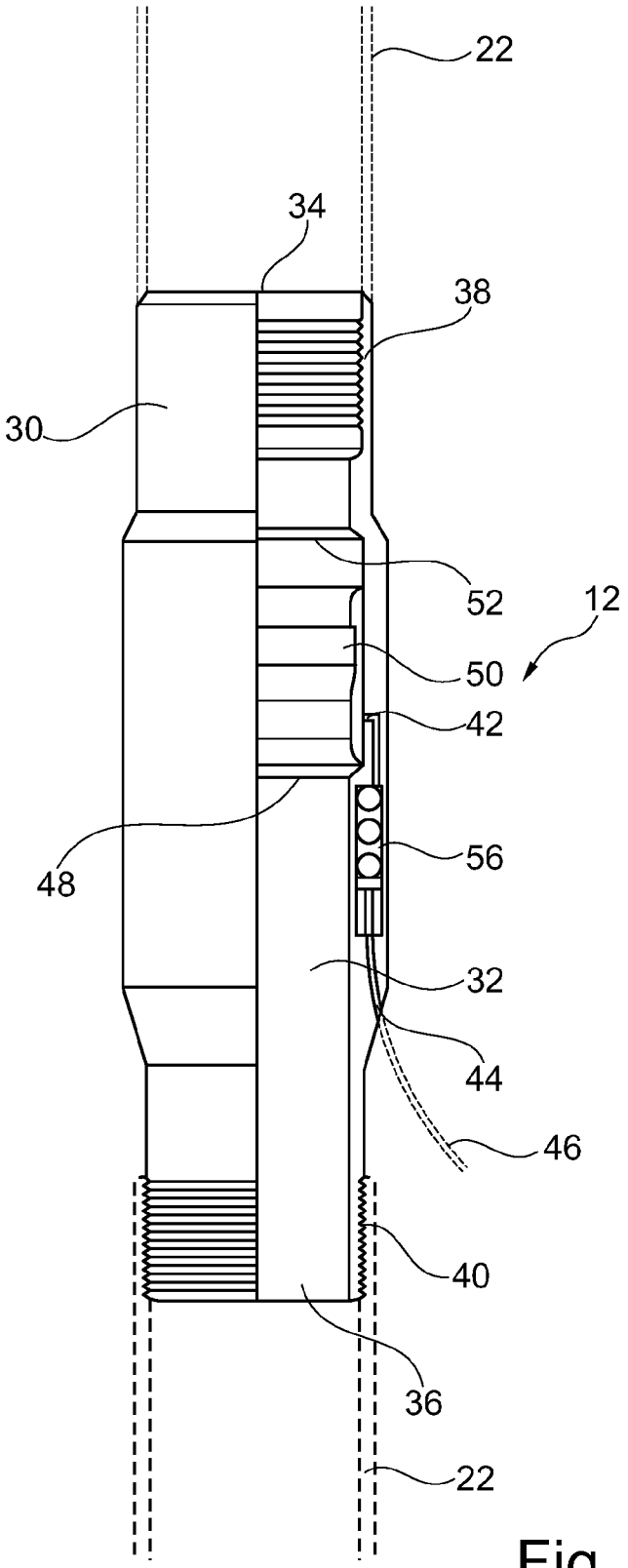
FIG. 2 is a schematic representation of the actuating apparatus in accordance with the first embodiment of the present invention.

FIG. 2 illustrates a schematic representation of an actuating apparatus 12 according to a first embodiment of the present invention. The actuating apparatus 12 provides a secondary actuator operable to open a downhole valve 10 that has failed to open under operation of a primary actuator or a downhole valve assembly that has become disconnected in the event of a well workover as discussed further below.

The actuating apparatus 12 according to the first embodiment of the present invention comprises a tubular body 30, which includes an axial bore 32 between an inlet end 34 and an outlet end 36. The inlet 34 and the outlet 36 each comprise a threaded connection 38, 40 for attachment to the production tubing 22 of a downhole assembly. As illustrated simply in FIG. 2, the tubular body 30 comprises an inlet port 42 and an outlet port 44 that extend in part radially through the tubular body 30.

The inlet port 42 is in fluid communication with the axial bore 32 of the tubular body 30 and therefore also with the inside diameter of the production tubing 22, in particular with the region uphole of the apparatus 12.

Figure 4:
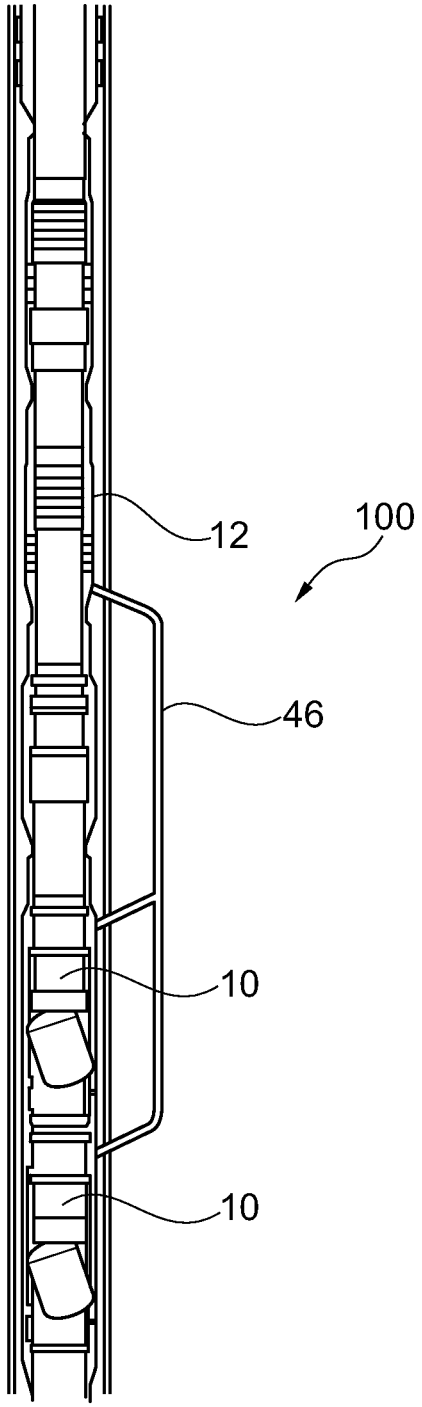
FIG. 4 is a schematic representation of an actuating apparatus operable to simultaneously open two downhole valves in accordance with a first embodiment of the present invention.

The outlet port 44 is in fluid communication with a conduit 46 (see FIG. 4) that fluidly couples the actuating apparatus 12 with a downhole valve assembly 10 in a region downhole of the actuating apparatus 12.

The actuating apparatus 12 includes a mechanically actuated sleeve 48 that moves by the action of retrieval/withdrawal of a washpipe or stinger (not illustrated) from the completion assembly 100.

The washpipe or stinger (not illustrated) includes a mechanical coupling device such as collet fingers that are operable to engage with the profiled section 50 of the sleeve 48 such that the washpipe or stinger engages with and pulls the sleeve 48 as the washpipe or stinger is pulled from the completion assembly 100. The sleeve 48 reaches a stop 52 inside the body 30, at which point the washpipe or stinger disengages from the sleeve 48. At this point the sleeve has reached the limit of its movement and opens the inlet port 42 such that the actuating apparatus 12 is primed and ready for operation.

The actuating apparatus 12 comprises an internal actuation mechanism 56, which is illustrated simply in FIG. 2 as a piston and spring arrangement.

Figure 3:
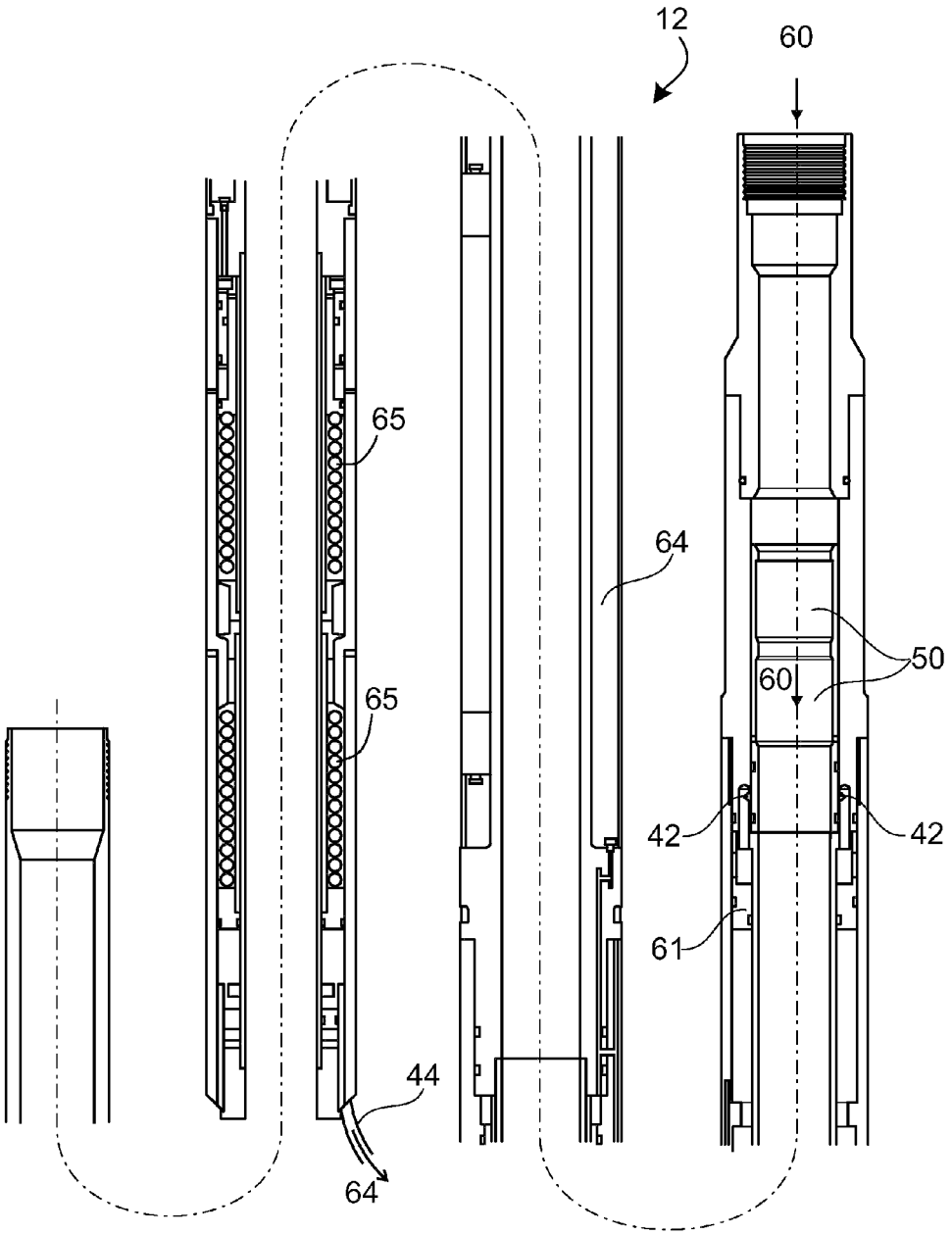
FIG. 3 is a schematic representation of the actuating apparatus in accordance with the first embodiment of the present invention.

A more detailed representation of the actuating apparatus 12 is provided in FIG. 3.

FIG. 3 shows the actuating apparatus 12 according to the first embodiment of the present invention and illustrates a flow path 60 of fluid through the actuating apparatus 12 that is required to operate the downhole valve 10.

In the case of a producing well and in the event that a downhole valve assembly 10 fails to open, the actuating apparatus 12 is primed by action of retrieval of a stinger or washpipe coupled to the coupling member 50 to open the inlet port 42. Once primed, the application of tubing pressure 60 acts on the piston 61 via the inlet port 42 to move the piston 61 such that hydraulic fluid 64 contained within the actuating apparatus 12 is displaced from the outlet port 44 and to the downhole valve 10 via a conduit 44 such that the valve 10 is actuated. Once activated, the inlet port 42 is open and the action of fluid pressure on the piston 61 acts to displace the fluid to actuate the downhole valve. When the fluid is being displaced, it will be appreciated that, any hydraulic pressure or locomotion force will deteriorate due to the motion of the fluid. Therefore, one or more springs 65 act upon the piston 61 to assist it to continue to apply a downwards force such that the fluid is fully displaced to ensure actuation of the valve.

The axial bore 32 is permanently open such that when flow of production fluid is resumed the actuating apparatus does not impede flow.

As described above with reference to FIGS. 2 and 3, the actuating apparatus 12 comprises a mechanically actuated sleeve 48. When each of an intermediate and an upper completion assembly are run into the well bore a washpipe or stinger respectively is engaged with the assembly.

On completing the intermediate completion assembly and prior to installing the upper completion assembly the washpipe is removed. Upon removal of the wash pipe, the wash pipe engages with the sleeve 48 on the actuating apparatus 12 and moves the sleeve 48 such that the inlet port 42 is open and ready if secondary actuation is required to open a downhole valve.

In an upper completion assembly the actuating apparatus 12 according to the first embodiment of the invention is primed and ready for use on removal of the stinger; removal of which prepares the well for workover. Removal of the stinger disengages all control lines from the surface such that the normal operation of downhole valves etc is disabled. Following workover of a well the actuating apparatus 12 according to the first embodiment of the invention may be used to re-open a closed valve such that a flow path for production fluid is re-established.

As described above with reference to FIGS. 2 and 3, the actuating apparatus 12 operates to open the valve by application of fluid pressure through the inside of the production tubing from a region uphole of the actuating apparatus 12 and the valve 10.

Figure 5:
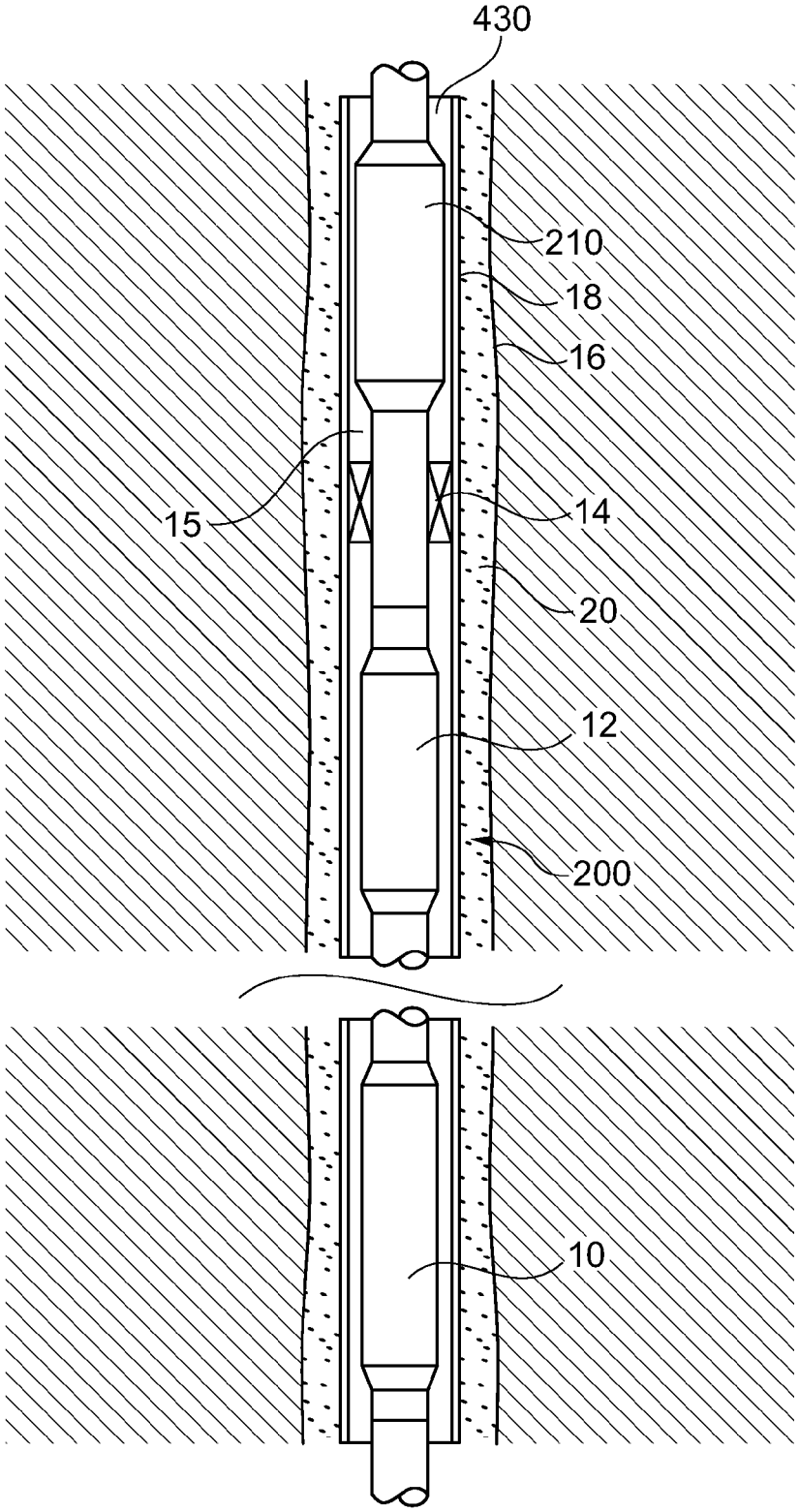
FIG. 5 is a schematic representation of a wellbore assembly comprising an actuating apparatus in accordance with first and second embodiments of the present invention.

Referring to FIG. 5, a partial longitudinal view of a wellbore completion arrangement 200 is illustrated. The wellbore completion arrangement 200 comprises a downhole valve assembly 10, a first actuating apparatus 12, a packer assembly 14 and a second actuating apparatus 210.

The second actuating apparatus 210 is representative of an actuating apparatus in accordance with a second embodiment of the present invention. The second actuating apparatus 210 will be hereinafter referred to as an annular closing actuator 210 such that it is distinguishable from the first actuating apparatus 12 that has been described above as the first embodiment of the present invention and with reference to FIGS. 1 to 3.

In the illustrated example, the wellbore 16 is lined with a casing 18, which in the illustrated embodiment is held in place with cement 20.

The downhole valve assembly 10, the first actuating apparatus 12, the annular closing actuator 210 and the packer assembly 14 are all run into the wellbore as part of the well completion assembly 200 on a stinger (not illustrated).

The packer assembly 14 provides a seal in the annulus region 15, which is defined by the space between the outside of the production tubing 22 and the inside of the casing 18.

In the illustrated embodiment the downhole valve assembly 10 is run-in in an open configuration and is subsequently closed when it has reached its location downhole. As described above with reference to FIG. 1, the integrity of the casing and the well is checked before bringing the well online. Following successful testing the downhole valve assembly 10 can be re-opened such that production fluid can flow unimpeded through the downhole valve assembly 10 when the well is brought on line.

In the event that workover of a producing well is required the downhole valve 10 must be closed to shut-off production from the downhole region of the well. Primary actuation to close the downhole valve 10 may be done by applying fluid pressure from surface via a control line (not illustrated). However, if primary actuation fails to close the valve 10 workover of the well is delayed or prevented until production flow can be closed off.

The annular closing actuator 210 according to the second embodiment of the present invention provides a secondary actuator to close the valve 10 in the event that primary actuation failed.

Figure 6:
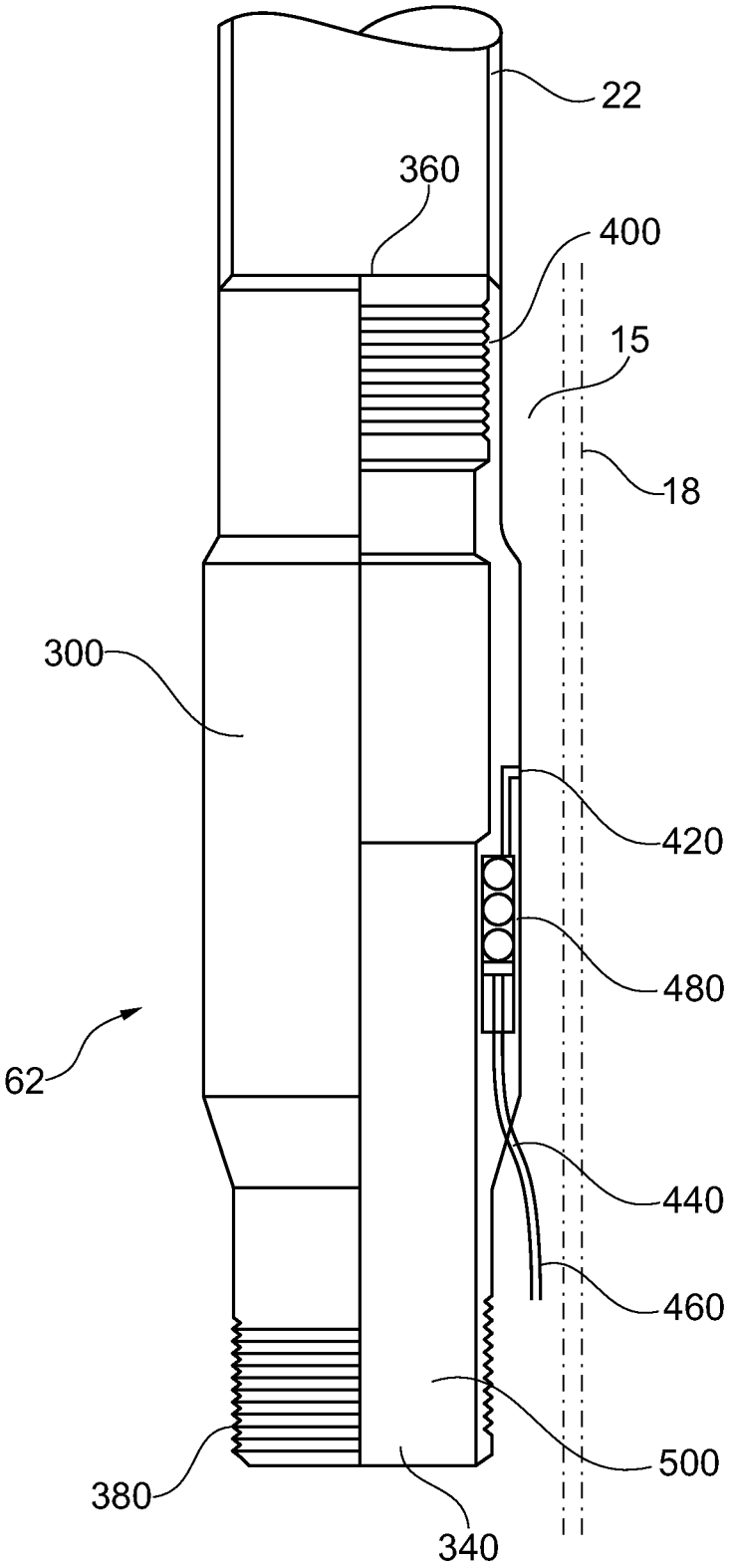
FIG. 6 is a schematic representation of the actuating apparatus in accordance with the second embodiment of the present invention.

FIG. 6 illustrates a schematic representation of an annular closing actuator 62 according to the second embodiment of the present invention.

The annular closing actuator 62 according to the second embodiment of the present invention comprises a tubular body 300, which includes an axial bore 320 between an inlet end 340 and an outlet end 360. The inlet 340 and the outlet 360 each comprise a threaded connection 380, 400 for attachment to the production tubing 22 of a downhole assembly. As illustrated simply in FIG. 2, the tubular body 300 also comprises an inlet port 420 and an outlet port 440 that extend in part radially through the tubular body 300.

The inlet port 420 is in fluid communication with the outside of the tubular body 300 and therefore also with the annulus region of the well. Referring to FIG. 5, the annulus 15 is defined by the space between the outside diameter of the production tubing 22 and the inside diameter of the casing 18.

The outlet port 440 is in fluid communication with conduit 460 that fluidly couples the annular closing actuator 62 with a downhole valve assembly 10 in a region downhole of the annular closing actuator 62.

The annular closing valve 62 uses fluid pressure from the annulus 15 to actuate a downhole valve 10. Therefore, in the illustrated embodiment the annulus fluid flow is provided from a region uphole of the annular closing valve 62 and uphole of the packer 14.

The annular closing actuator 62 includes an internal actuation mechanism 480, which is illustrated simply in FIG. 6 as a piston and spring arrangement.

Figure 7:
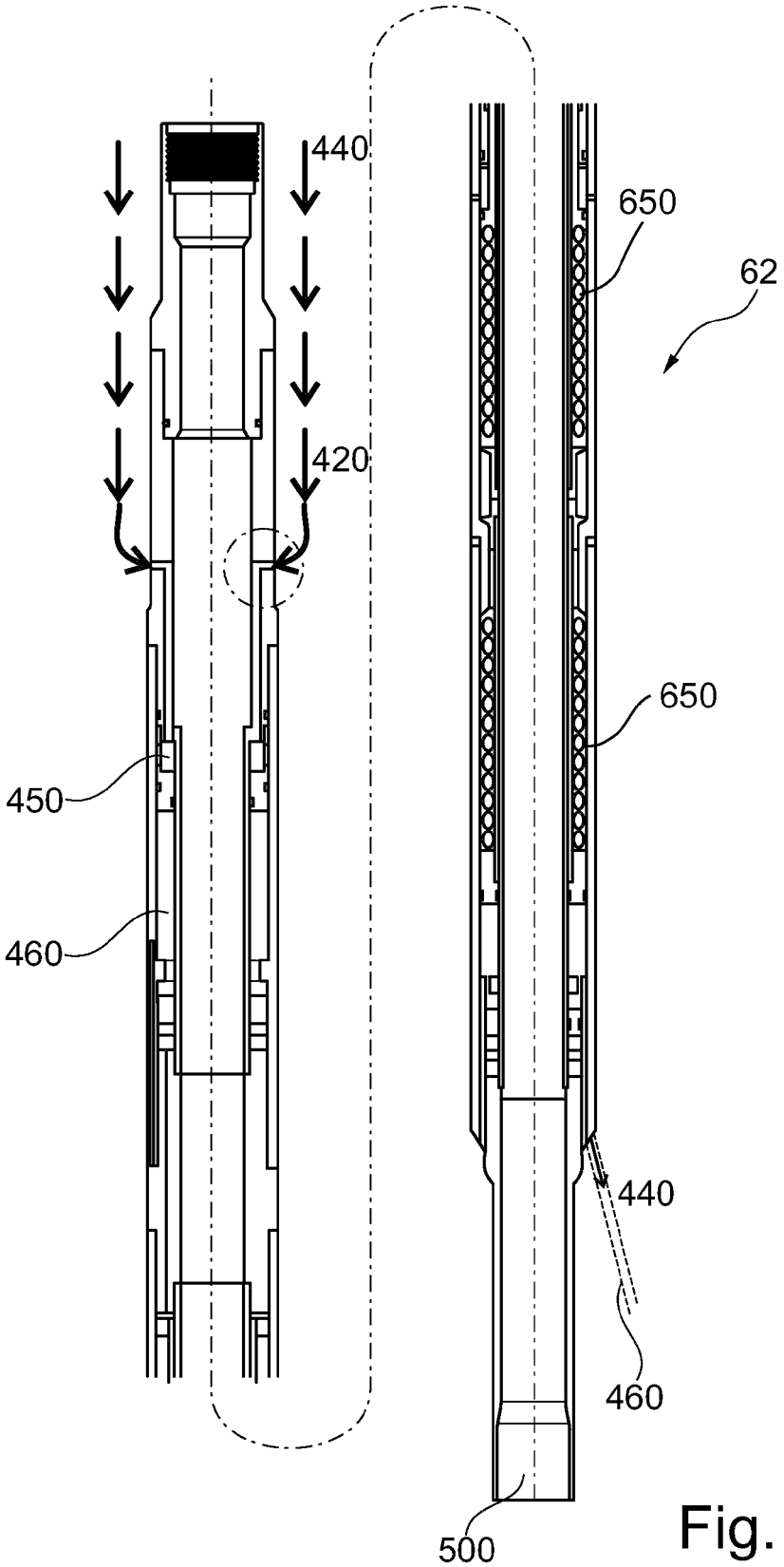
FIG. 7 is a schematic representation of the actuating apparatus in accordance with the second embodiment of the present invention.

A more detailed representation of the annular closing actuator 62 is illustrated in FIG. 7.

FIG. 7 shows the annular closing actuator 62 according to the second embodiment of the present invention and illustrates the flow path 440 of fluid through the annular closing actuator 62 that is required to operate the downhole valve 10.

In the event that a downhole valve assembly 10 fails to open or close, the application of annulus fluid pressure 440 acts on the piston 450 via the inlet port 420 to move the piston 450 such that hydraulic fluid 460 contained within the annular closing actuator 62 is displaced from the outlet port 440 and to the downhole valve 10 via a conduit 460 such that the valve 10 is opened or closed. Once activated, the inlet port 420 is open and the action of fluid pressure on the piston 450 acts to displace the fluid to actuate the downhole valve 10. When the fluid is being displaced, it will be appreciated that, any hydraulic pressure or locomotion force will deteriorate due to the motion of the fluid. Therefore, one or more springs 650 act upon the piston 450 to assist the piston 450 such that it continues to apply a downwards force such that the fluid is fully displaced to ensure actuation of the valve 10.

The axial bore 500 of the annular closing actuator 62 is permanently open such that when flow of production fluid is resumed the annular closing actuator 62 does not impede flow.

Figure 8:
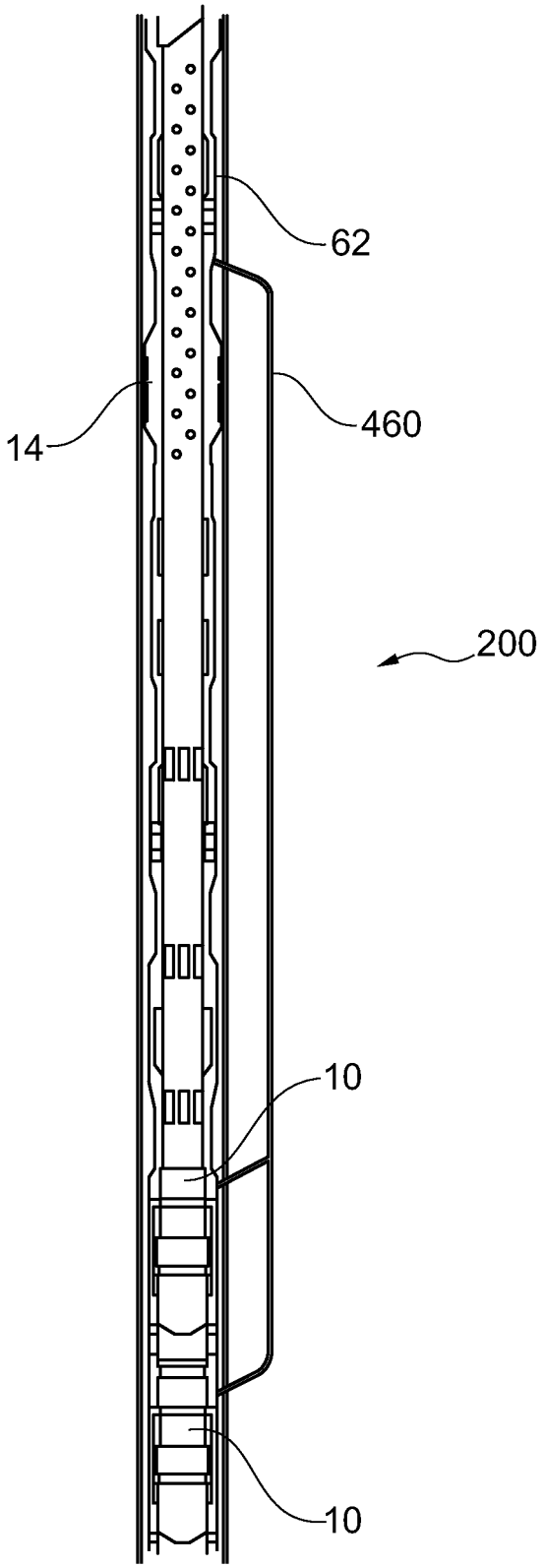
FIG. 8 is a schematic representation of the actuating apparatus operable to simultaneously close two downhole valves in accordance with the second embodiment of the present invention.

FIG. 8 illustrates a flow path defined in an upper completion assembly 200 whereby conduit 460 fluidly couples the annular closing actuator 62 to two downhole valves 10. The operation of the annular closing actuator 62 upon application of annulus pressure from uphole of the annular closing actuator 62, the valves 10 and the packer 14 simultaneously close the two valves 10.

In summary, each of the embodiments described above may be used in relation to workover of a well. The actuating apparatus 12 according to the first embodiment is operable to open a downhole valve and therefore re-establishes production flow in a producing well following removal of the stinger and upper completion. The annular closing actuator 62 according to the second embodiment of the invention is operable to ensure opening or closure of one or more downhole valves such that the well is ready for workover.

In addition, the actuating apparatus 12 according to the first embodiment of the invention is primed and ready for use on removal of the washpipe from an intermediate completion assembly. Therefore, the actuating apparatus 12 may be used at any stage in production to open a downhole valve even in the event that a downhole valve 10 inadvertently closes and shuts off production.

An advantage provided by the actuating apparatus 12 and the annular closing actuator 62 according to each embodiment of the invention may be that production downtime due to a failed valve is minimal because the actuating apparatus 12 is primed for use on routine removal of a washpipe or stinger and therefore subsequent application of fluid pressure from a region uphole of the failed valve 10 is operable to open the downhole valve and therefore production downtime is minimal compared with the remedial methods described above.

Furthermore, each of the first actuating apparatus 12 and the annular closing actuator 62 according to the first and second embodiments of the invention respectively provide a back-up and contingency device that offers reassurance and certainty that a producing well is substantially failsafe.

While specific embodiments of the present invention have been described above, it will be appreciated that departures from the described embodiments may still fall within the scope of the present invention.

What is claimed is:

1. An actuating apparatus for a downhole valve; the actuating apparatus comprises:

a tubular body comprising an axial bore extending through the body;

an inlet port extending radially and at least partially through the tubular body, the inlet port being in fluid communication, when open, with a region uphole of the actuating apparatus;

an actuating member operable by application of fluid pressure from a region uphole of the actuating apparatus via the inlet port to actuate the valve, the actuating member comprising:

a piston member to which fluid pressure is applied via the inlet port, such that movement of the piston member facilitates actuation of the valve; and a spring adapted to apply a spring force on the piston member, such that movement of the piston member displaces hydraulic fluid through an outlet, the outlet fluidly coupled to the downhole valve, such that upon operation of the actuating member, hydraulic fluid is displaced to actuate the valve; and a mechanically actuated operating member operable to move between a first position and a second position, with fluid communication via the inlet port being disabled when the mechanically actuated operating member is in the first position and fluid communication via the inlet port being enabled when the mechanically actuated operating member is in the second position.

2. The actuating apparatus as claimed in claim 1, wherein fluid communication between the actuating apparatus and the downhole valve comprises a conduit that is contained within a downhole completion.

3. The actuating apparatus as claimed in claim 2, wherein the conduit extends from the outlet of the actuating apparatus to the downhole valve.

4. The actuating apparatus as claimed claim 1, wherein the inlet port, when open, fluidly couples a region uphole of the actuating apparatus and the valve.

5. The actuating apparatus as claimed claim 1, further comprising a plurality of hydraulic actuators, at least one of the hydraulic actuators being associated with the downhole valve, and at least one other of the hydraulic actuators being associated with at least one other downhole valve to be operated.

6. The actuating apparatus as claimed in claim 5, wherein operation of each of the hydraulic actuators simultaneously operates each of the associated downhole valves.

7. The actuating apparatus as claimed in claim 1, comprising a secondary actuator.

8. The actuating apparatus as claimed in claim 1, wherein movement of the mechanically actuated operating member to the second position selectively opens the inlet port thereby priming the actuating apparatus for use.

9. The actuating apparatus as claimed in claim 1, wherein the mechanically actuated operating member comprises a coupling member operable to be coupled with a corresponding coupling member of an extractable downhole tool.

10. The actuating apparatus as claimed in claim 9, wherein engagement of the coupling member of the downhole tool with the coupling member of the mechanically actuated operating member and extraction of the downhole tool is operable to move the operating member thereby opening the inlet port.

11. The actuating apparatus as claimed in claim 10, wherein movement of the mechanically operated actuating member is sliding.

12. The actuating apparatus as claimed in claim 10, wherein the coupling member of the downhole tool and the coupling member of the operating member are adapted to disengage when the inlet port is open.

13. The actuating apparatus as claimed in claim 1, wherein the operating member comprises a sleeve.

14. The actuating apparatus as claimed in claim 1, wherein the inlet port is open to the axial bore side of the tubular body and wherein application of tubing pressure from an uphole region of the actuating apparatus is operable to actuate a downhole valve via the inlet port.

15. The actuating apparatus as claimed in claim 1 operable to open or close a downhole valve.

16. An actuating apparatus for a downhole valve; the actuating apparatus comprises:

a tubular body comprising an axial bore extending through the body;

an inlet port extending radially and at least partially through the tubular body, the inlet port open to the axial bore side of the tubular body and in fluid communication, when open, with a region uphole of the actuating apparatus;

an actuating member operable by application of fluid pressure from a region uphole of the actuating apparatus via the inlet port to actuate the valve, the actuating member comprising:

a piston member to which fluid pressure is applied via the inlet port, such that movement of the piston member facilitates actuation of the valve; and a spring adapted to apply a spring force on the piston member, such that movement of the piston member displaces hydraulic fluid through an outlet, the outlet fluidly coupled to the downhole valve, such that upon operation of the actuating member, hydraulic fluid is displaced to actuate the valve.

17. The actuating apparatus as claimed in claim 16, further comprising a mechanically actuated operating member operable to move between a first position and a second position, with fluid communication via the inlet port being disabled when the mechanically actuated operating member is in the first position and fluid communication via the inlet port being enabled when the mechanically actuated operating member is in the second position.

18. The actuating apparatus as claimed in claim 17, wherein movement of the mechanically actuated operating member to the second position selectively opens the inlet port thereby priming the actuating apparatus for use.

19. The actuating apparatus as claimed in any claim 17, wherein the mechanically actuated operating member comprises a coupling member operable to be coupled with a corresponding coupling member of an extractable downhole tool.

20. The actuating apparatus as claimed in claim 19, wherein engagement of the coupling member of the downhole tool with the coupling member of the mechanically actuated operating member and extraction of the downhole tool is operable to move the operating member thereby opening the inlet port.

* * * * *